US010518119B2

(12) United States Patent
Klug et al.

(10) Patent No.: US 10,518,119 B2
(45) Date of Patent: Dec. 31, 2019

(54) COMPACT MINIATURE FIRE-EXTINGUISHING AND/OR FIRE-PROTECTION DEVICE

(71) Applicant: JOB Lizenz GmbH & Co. KG, Ahrensburg (DE)

(72) Inventors: Rüdiger Klug, Ahrensburg (DE); Bodo Müller, Tornesch (DE); Jürgen Teschner, Hamburg (DE)

(73) Assignee: Job Lizenz GmbH & Co. KG, Ahrensburg (DE)

( * ) Notice: Subject to any disclaimer, the term of this patent is extended or adjusted under 35 U.S.C. 154(b) by 307 days.

(21) Appl. No.: 15/302,282

(22) PCT Filed: Mar. 11, 2015

(86) PCT No.: PCT/EP2015/055039
§ 371 (c)(1),
(2) Date: Oct. 6, 2016

(87) PCT Pub. No.: WO2015/161955
PCT Pub. Date: Oct. 29, 2015

(65) Prior Publication Data

US 2017/0036048 A1 Feb. 9, 2017

(30) Foreign Application Priority Data

Apr. 22, 2014 (DE) ..... 20 2014 101 880 U

(51) Int. Cl.
*A62C 37/11* (2006.01)
*A62C 35/10* (2006.01)
*A62C 3/00* (2006.01)

(52) U.S. Cl.
CPC ..... *A62C 37/11* (2013.01); *A62C 3/00* (2013.01); *A62C 35/10* (2013.01)

(58) Field of Classification Search
CPC ..... A62C 13/00; A62C 13/62; A62C 13/64; A62C 3/00; A62C 35/08; A62C 35/10; A62C 37/11; Y10T 137/1963; F17C 13/04
(Continued)

(56) References Cited

U.S. PATENT DOCUMENTS 3,664,430 A * 5/1972 Sitabkhan ..... A62C 37/50 169/23
5,551,517 A * 9/1996 Arsenault ..... A62C 37/12 169/26
(Continued)

FOREIGN PATENT DOCUMENTS

DE 19911530 C2 5/2001
DE 10242056 B3 3/2004
(Continued)

*Primary Examiner* — Jason J Boeckmann
(74) *Attorney, Agent, or Firm* — Sand, Sebolt & Wernow Co., LPA

(57) ABSTRACT

A fire-extinguishing or fire-protection device formed from a pressure vessel filled with a pressurized extinguishing medium. The device has an exit opening closed by a closure element which can be perforated by a perforation element. The pressurized extinguishing medium is held back in the pressure vessel from a passively thermally controlled trigger valve attached directly to the exit opening. The valve has a perforation element and a thermal triggering element. The perforation element is prestressed in a triggering position and is retained by the thermal triggering element in a standby position. When the triggering element is triggered as a result of a predetermined temperature being reached, the perforation element is released moving the triggering element to the triggering position in which it perforates the closure element. A thermal trigger valve suitable for use in the fire-extinguishing or fire-protection device is disclosed.

22 Claims, 4 Drawing Sheets

(58) Field of Classification Search
USPC ..... 169/19, 30, 71, 89; 137/79, 80; 222/5, 222/80
See application file for complete search history.

(56) References Cited

U.S. PATENT DOCUMENTS

| | | | | | |
|---|---|---|---|---|---|
| 6,138,768 | A * | 10/2000 | Fujiki | ..... | A62C 13/62 169/30 |
| 6,286,536 | B1 * | 9/2001 | Kamp | ..... | F16K 17/38 137/68.13 |
| 7,703,640 | B1 | 4/2010 | Hollars et al. | | |

FOREIGN PATENT DOCUMENTS

| | | | |
|---|---|---|---|
| DE | 102009023422 | A1 | 12/2010 |
| DE | 102011087608 | B3 | 1/2013 |
| EP | 0630663 | A1 | 12/1994 |
| EP | 1905485 | A2 | 4/2008 |
| EP | 2332616 | A1 | 6/2011 |

* cited by examiner

COMPACT MINIATURE FIRE-EXTINGUISHING AND/OR FIRE-PROTECTION DEVICE

TECHNICAL FIELD

The invention relates to a fire extinguishing and/or fire protection device formed from a pressure container filled with a pressurized extinguishing medium and having an exit opening that is sealed in such a way with a closure element perforable by means of a perforation element that the pressurized extinguishing medium is retained in the pressure container, and a passively thermally controlled trigger valve seated directly on the exit opening and having a perforation element and a thermal triggering element, wherein the perforation element is pretensioned in the direction of a triggering position and held by the thermal triggering element in a standby position that is different from the triggering position and wherein when triggered by a predetermined triggering temperature being reached, the thermal triggering element releases the perforation element in such a way that, driven by the pretensioning to which it is subjected in the standby position, it moves into the triggering position in which it perforates the closure element. It further relates to a passively thermally controlled trigger valve with the features for forming a fire extinguishing and/or fire protection with a bearing part, a triggering part that can be moved relative to the bearing part between a standby position and a triggering position, a perforation element arranged on the triggering part, a spring means arranged between the bearing part and the triggering part, which pretensions the triggering part relative to the bearing part in the triggering position, and a thermal triggering element, which holds the triggering part in the standby position against the pretensioning exerted by the spring means, characterized in that the triggering part, at least in one section, is configured sleeve-like and is seated on the bearing part and is moveable in a longitudinal direction of the bearing part on the bearing part between the standby position and the triggering position.

PRIOR ART

The provision of extinguishing devices and/or fire protection devices that are triggered by means of thermal triggering elements and release an extinguishing medium for extinguishing a fire and/or for fire protection when the ambient temperature increases above a normal and tolerable level has been known for a long time. Whereas such devices have been known for a long time for the protection of large areas, particularly in the form of sprinkler systems in indoor areas of buildings, e.g., office areas, living areas, roofed-in garages, or the like, for some time more thought has been given to using corresponding fire extinguishing and/or fire protection devices for safeguarding smaller areas and spaces.

For example, DE 10 2009 023 422 A1 describes an electric construction component enclosed in a housing, which in an exemplary embodiment comprises an electric reading light for arrangement in an aircraft, wherein due to a special fire hazard associated with this electrical component, a miniaturized extinguishing device is arranged inside the housing, which device is suitable for extinguishing and/or preventing a fire arising inside the housing by releasing an extinguishing medium. A thermal sensor, which can be a bimetal or a memory metal, for example, is proposed for triggering this extinguishing device. As an advantage of these sensor components, mention is made of the possibility of enabling a passive, in particular currentless monitoring of the ambient temperature here. A more detailed description of the way in which the miniature extinguishing device described in DE 10 2009 023 422 A1 is constructed is not given therein.

Another example of providing locally concentrated extinguishing capacities in fire hazard zones of closely confined spaces is described in DE 10 2011 087 608 B3. This document discloses a clothes dryer that is equipped with a passive extinguishing system. In the passive extinguishing system presented therein, provision is made of an extinguishing agent tank in the form of a centrally-positioned container, from which extinguishing agent lines are run to various critical and flammable points. These extinguishing agent lines are closed with thermally triggered valves such that in the event of a fire at one of the critical sites, the respective valve opens and the extinguishing medium can be fed from the centrally-positioned container via the allocated extinguishing agent line to the potential hotspot, where it can flow out. As examples of thermal triggering elements for the thermally triggered valves, this document mentions so-called thermo-bulbs, which are tube-like glass vessels closed at both ends and filled with a thermal triggering fluid, which expands when a predetermined triggering temperature is reached or exceeded in such a way that it causes the wall of the glass vessel to burst due to the built-up pressure, thus destroying the thermal triggering element and opening the valve.

DE 199 11 530 C2 shows a similar thermal triggering element as a component of a valve array, wherein in an exemplary embodiment shown in FIG. 4 of that document, the trigger valve has a perforation element in the form of a hollow needle, which hollow needle is arranged on a triggering part. The triggering part is held in a standby position by a thermal triggering element (here also a so-called thermo-bulb) and is pretensioned by a spiral spring in the direction of a triggering position, into which it moves and thus pushes the hollow needle forward if the thermal triggering element is triggered (the thermo-bulb bursts). In this triggering position, the hollow needle perforates and pierces a sealing membrane that seals a transfer port. The thermal trigger valve shown here is described in the context of a use as a safety valve for a compressed gas container, which valve opens an emergency opening for letting out the compressed gas when a triggering temperature exceeds a critical level in order to relieve the container, which is under pressure and filled with a possibly flammable gas, and thus eliminate a fire and/or explosion hazard. However, in principle the valve shown in DE 199 11 530 C2 can also be conceived as a trigger valve for a fire extinguishing and/or fire protection device, in which a compressed extinguishing medium rather than a pressurized flammable gas is present in the transfer port.

Lastly, EP 2 332 616 A1 describes another option for protecting electrical devices from fire. In the solution shown therein, a tank or supply container for an extinguishing medium is integrated in a housing part, wherein the supply container is designed such that it opens openings when a critical temperature is exceeded, for example by the melting of appropriate material of a wall, through which opening the extinguishing agent (e.g., C6-fluoroketone) in the supply container is then released.

A thermally triggered bleed valve is described in U.S. Pat. No. 7,703,640 B1, which is mounted on pressurized gas containers in order to open the latter in the event of overheating and thus bleed off the gas contained in the container and prevent the gas container from bursting. A fire extinguishing or fire protection device is not disclosed in this document.

Hence there is clearly a great need for miniaturized fire extinguishing and/or fire protection devices that can be used to equip and protect specifically delimited spaces exposed to an increased fire hazard. For example, this applies to certain areas of and in household appliances, for example such areas in which heat-producing electronic components are disposed (e.g., switch and control panels with their housing), but also areas in which such appliances themselves generate process heat, as is the case with clothes dryers, for example. Here in particular there is a need to provide a fire extinguishing and/or fire protection device configured as an independent element and component, which can be designed with compact dimensions and used as an independent element in a flexible and stand-alone manner in many applications in an at-risk zone and/or in a space exposed to a fire hazard, and which can release, directly at the deployment location if triggered, a quantity of extinguishing agent suited to the volume of the compartment in which it is disposed and thus prevent a fire, extinguish a local fire that may have already started and prevent such a fire from spreading, but also ensure that other elements and parts of, e.g., a larger household appliance or of a more complex structure such as an entire aircraft, are not damaged by the use of the extinguishing agent or extinguishing medium.

BRIEF DESCRIPTION OF THE INVENTION

The object of the invention is to propose an appropriate fire extinguishing and/or fire protection device. With a further aspect, the object of the invention is to provide a passively thermally controlled trigger valve suitable for use in such a fire extinguishing and/or fire protection device.

In terms of the fire extinguisher and/or fire protection device to be proposed, this object is achieved by such a device formed from a pressure container filled with a pressurized extinguishing medium and having an exit opening that is sealed in such a way with a closure element perforable by means of a perforation element that the pressurized extinguishing medium is retained in the pressure container, and a passively thermally controlled trigger valve seated directly on the exit opening and having a perforation element and a thermal triggering element, wherein the perforation element is pretensioned in the direction of a triggering position and held by the thermal triggering element in a standby position that is different from the triggering position and wherein when triggered by a predetermined triggering temperature being reached, the thermal triggering element releases the perforation element in such a way that, driven by the pretensioning to which it is subjected in the standby position, it moves into the triggering position in which it perforates the closure element. Advantageous developments that the pressure container has an inner volume of 10 ml to 1500 ml. The extinguishing medium is an oxygen-binding and/or oxygen-displacing extinguishing gas. The trigger valve has a media guide channel connected to the exit opening and distribution openings for the extinguishing medium, by means of which the extinguishing medium is distributed in the event of triggering. The thermal triggering element is a glass vessel completely surrounding an inner space with a triggering fluid enclosed in the inner space, said triggering fluid expanding at the predetermined triggering temperature until the glass vessel bursts. The pressure container has a first screw thread in the zone of the exit opening and that the trigger valve has a second screw thread complementary to the first screw thread in a connecting section, wherein the pressure container and the trigger valve are connected by screwing the first and second screw threads together in order to form the fire extinguishing and/or fire protection device. A triggering sensor system may be provide that emits a signal if the thermally controlled trigger valve has been triggered. An electrically actuatable remote triggering device may also be provided. A passively thermally controlled trigger valve is disclosed for forming a fire extinguishing and/or fire protection with a bearing part, a triggering part that can be moved relative to the bearing part between a standby position and a triggering position, a perforation element arranged on the triggering part, a spring means arranged between the bearing part and the triggering part, which pretensions the triggering part relative to the bearing part in the triggering position, and a thermal triggering element, which holds the triggering part in the standby position against the pretensioning exerted by the spring means, characterized in that the triggering part, at least in one section, is configured sleeve-like and is seated on the bearing part and is moveable in a longitudinal direction of the bearing part on the bearing part between the standby position and the triggering position. Advantageous developments of such a trigger valve in that the bearing part forms a guide for the triggering part as it moves from the standby position into the triggering position with an outer surface, on which the triggering part configured as sleeve-like in at least one section is seated. The trigger valve triggering part has a sleeve section and a dome section that is closed on an end face. A bearing surface is formed as a thrust bearing for an in particular axial end of the thermal triggering element on an inner surface of the dome section. Lateral exit openings in the outer wall of the triggering part, which connect the interior thereof with an outer side and which are arranged in particular directly below the dome section. The bearing part has an essentially circular cylindrical form. The trigger valve has a connecting structure, in particular a thread, on one end, in particular a frontal end, for being joined and connected to an exit opening sealed with a perforable closure element. A support bearing for the spring means arranged on the triggering part. The triggering part has the support bearing for the spring means in a longitudinal extension on a first side, and a thrust bearing for the thermal triggering element on a second side opposite the first side, wherein between the support bearing and the thrust bearing, first the spring means and, on the other side of the spring means, then the thermal triggering element are arranged behind one another when viewed in the longitudinal extension. The support bearing is formed by a bearing pin attached to opposite wall zones of a section of the sleeve-like triggering part and extending perpendicular to the longitudinal extension of the triggering part, which bearing pin passes through guide slots in the bearing part. The trigger valve is characterized by an axial bore in the bearing part, in which bore the spring means is arranged and comes into abutment on one side with a spring bearing delimiting the axial boring on an end face thereof. The thermal triggering element comprises a glass vessel that completely surrounds an inner space, with a triggering fluid enclosed in the inner space and expanding at a predetermined triggering temperature until the glass vessel bursts. The perforation element comprises a needle. The trigger valve has a triggering sensor system that emits a signal if the thermally controlled trigger valve is triggered. The trigger valve has an electrically actuatable remote triggering device.

With the invention, provision is initially made of a novel fire extinguisher and/or fire protection device, which according to the invention is formed from a pressure container filled with pressurized extinguishing medium and from a passively thermally controlled trigger valve. The pressure container has an exit opening that is sealed in such a way with a closure element perforable by means of a perforation element that the pressurized extinguishing medium is retained in the pressure container. Such a closure element can be, for example, a sealing membrane, a sealing film, a rupture disc, or the like. The decisive factor here is that this closure element reliably ensures a retention of the extinguishing medium on the one hand and is configured in terms of its structure and properties in such a way that it can be perforated by the perforation element in order to open the exit opening and thus enable the extinguishing medium to exit.

For the fire extinguishing and/or fire protection device according to the invention, it is furthermore important that the passively thermally controlled trigger valve is mounted directly on the exit opening, i.e., without interposition of any other connecting lines, extension lines, or the like. This is important because only in this manner is it possible for the fire extinguishing and/or fire protection device according to the invention to be in the desired compact and space-saving structural shape and also to be integrated as a stand-alone unit for fire protection in small compartments and structural elements, e.g., in electronic components enclosed in housings.

Another essential aspect is the fact that the trigger valve is passively thermally controlled, meaning that an active trigger control as is required with, say, sensors that have to transmit sensor signals that must be received and possibly even analyzed by an appropriate receiver, for example, is dispensed with. In this context, passively thermally controlled means in particular that the trigger valve does not need its own energy supply and as a whole does not rely on an operating voltage applied from the outside or an outside power source. Such thermal triggering elements can be made of, for example, an element formed from a thermocouple, but they can also be so-called thermo-bulbs as described in the preceding, in other words glass vessels in general, which completely enclose an interior space and in which the interior space is filled with a triggering fluid, which as a result of a predetermined triggering temperature being reached and thermal expansion accompanied by pressure development, causes the wall of the glass vessel to burst and thus irreversibly destroy the thermal triggering element.

In the fire extinguishing and/or fire protection device according to the invention, the perforation element, which is part of the trigger valve, is held in a standby position, this being brought about by the thermal triggering element. In the standby position, the perforation element is furthermore pretensioned in the direction of a triggering position, which can be brought about by, for example, a suitable spring or other comparably acting clamping means. The triggering position is such that the perforation element, upon reaching this position, perforates the closure element and thus opens the exit opening so that the pressurized extinguishing medium can flow out of the interior of the pressure container and effect the extinguishing. According to the invention, the trigger valve is configured such that, when this valve is triggered by a predetermined triggering temperature being reached (by means of an actuation of the thermal triggering element), the perforation element is released and, driven by the pretensioning to which it is subjected in the triggering position, moves into the triggering position.

From the above presentation and description, it can be readily discerned that with the invention, provision is made of a highly compact, highly effective fire extinguishing and/or fire protection device, which owing to the compact structural form can be disposed very well in close fitting spaces or housings that define sections or components at risk of fire. Furthermore, via selection of a capacity or rather interior volume of the pressure container a suitable adaptation is possible, wherein in particular the amount of extinguishing medium with which the inner volume is filled is measured in such a way that it is sufficient for preventing a fire or extinguishing an already started local fire with suitable efficacy in the space in which the fire extinguishing and/or fire protection device is being deployed, but that damage to adjacent zones is avoided by the fact that extinguishing medium is not released in excess.

In turns out that pressure containers with an interior volume of 10 ml to 1500 ml are very well suited for a wide range of applications. The reason for this is that such containers, especially if smaller sizes are chosen, are sufficiently small that they can also be installed in closer fitting installation situations on the one hand, but release a suitable extinguishing medium in sufficient volume and sufficient quantity for ensuring a sufficient extinguishing effect in case of a fire on the other hand. For this purpose, use is frequently made of pressure containers with volumes between 10 ml and 250 ml, in particular between 50 ml and 250 ml.

As an extinguishing medium, preference is given to the use of an extinguishing gas because it can be compressed to a high degree such that a small storage volume for the extinguishing gas will guarantee a sufficiently large displacement volume for the extinguishing action when the device is triggered. For this purpose, the extinguishing gas in the pressure container can in particular also be liquefied so that an even more effective volume increase is possible. The extinguishing gas is particularly advantageously an oxygen-binding and/or oxygen-displacing extinguishing gas. Instead of an extinguishing gas, use can also be made here of other pressurized extinguishing media, e.g., a mixture of a propellant and an extinguishing agent in powder form or assuming the form of an aerosol, or an appropriate extinguishing liquid. However, the use of an extinguishing gas is preferred, not only for the reasons already discussed above but also because appropriate gases cause the least amount of damage in the event of a triggering so that in particular components and structural elements unaffected by the fire that are located in the environment of a large device such as an electrically operated household appliance, e.g., a clothes dryer, a washing machine, a dishwasher, or the like, are not damaged if the fire extinguishing and/or fire protection device according to the invention is triggered. The functionality of a larger appliance thus equipped can thus be easily restored by replacing the fire-damaged component (e.g., an electronic switch panel with a housing) with a new component that is preferably also safeguarded with a fire extinguishing and/or fire protection device according to the invention.

In one possible embodiment, the trigger valve of the fire extinguishing and/or fire protection device according to the invention advantageously has a media guide channel connected to the exit opening as well as distributor openings for the extinguishing medium via which a distribution of the extinguishing medium is effected in the event of triggering. By way of the media guide channel, the extinguishing medium exiting the exit opening reaches the interior of the trigger valve and then the distributor openings (which can be distributor nozzles, for example) so that the extinguishing medium can be distributed in a targeted manner in the event of triggering. The distributor openings can be configured and arranged in accordance with the local conditions so that the extinguishing medium is distributed in such a way that it can be discharged directly, by the shortest possible route, and quickly in the direction of fire hazard zones.

In the context of another preferred embodiment, in the area of the exit opening the pressure container of the fire extinguishing and/or fire protection device according to the invention can have a first screw thread and the trigger valve can have a second screw thread in a connecting section that is complementary to the first screw thread so that in order to form the fire extinguishing and/or fire protection device, the pressure container and the trigger valve are connected by screwing the first and second screw threads together. For example, the first screw thread can be a male thread and the second screw thread can be a female thread. This variant enables easy assembly of the fire extinguishing and/or fire protection device according to the invention, wherein the pressure container is first filled with the extinguishing medium and sealed by the closure element, which closure element, particularly in the area of the exit opening, is seated on an upper edge of this exit opening that delimits the screw thread, and then the trigger valve is screwed on. It is certainly clear that the triggering position of the perforation element of the trigger valve is configured and situated in such a way that it lies in the area of the connecting section in which the trigger valve has the second screw thread, or rather the closure element of the exit opening of the pressure container can be perforated and opened by the perforation element in this area in the triggering position.

As provided according to an advantageous development of the invention, the fire extinguishing and/or fire protection device according to the invention can furthermore have a triggering sensor system that emits a signal upon the triggering of the thermally controlled trigger valve. Such a triggering sensor system can comprise, for example, an electric conductor that is interrupted and in turn breaks a sensor circuit when the thermal trigger valve is triggered. The triggering sensor system can also be formed by a normally open circuit, which is closed by the triggering of the thermal trigger valve and possibly by the movement of components thereof and thus emits a signal. A triggering sensor system signal can be used, for example, to trigger an alarm, but it can also be used to control other automatically engaging measures, for example to trigger other extinguishing mechanisms, close fire protection barriers, or the like.

In another aspect, the invention concerns a passively thermally controlled trigger valve that has the following elements:

- a bearing part,
- a triggering part moveable relative to the bearing part between a standby position and a triggering position,
- a perforation element arranged on the triggering part,
- a spring means that is arranged between the bearing part and the triggering part and pretensions the triggering part relative to the bearing part in the triggering position, and
- a thermal triggering element that holds the triggering part in the standby position against the pretensioning exerted by the spring means.

The passively thermally controlled trigger valve of the invention is thus distinguished by the fact that the triggering part is configured as sleeve-like and is seated on the bearing part and is moveable in a longitudinal direction of the bearing part on said bearing part between the standby position and the triggering position. This passively thermally controlled trigger valve thus designated and constructed is particularly suited for use in forming a fire extinguishing and/or fire protection device as described above, but is not limited to such a use. It can be used just as easily in, for example, an application like the one described in the aforementioned DE 199 11 530 C2, namely as a safety valve for a compressed gas container, or as a trigger valve for large fire extinguishing and/or fire protection devices or systems, e.g., as part of sprinkler systems.

In the embodiment as described and claimed above, a particularly reliable and well-built structure in terms of efficacy arises due to the fact that the triggering part is seated on the bearing part like a sleeve. This in particular enables an essentially axially symmetric configuration of the trigger valve, in particular a central arrangement of the thermal triggering element along a center axis. In this respect the passively thermally controlled trigger valve according to the invention also differs from the structure of a similarly functioning valve disclosed in the aforementioned DE 199 11 530 C2, which is illustrated in FIG. 4 of said document. The thermal triggering element therein is disposed acentrically as a result of the structure such that when the triggering element is triggered, not only does a force pulse directed in the longitudinal direction of the perforation element (shown in the form of a hollow needle therein) arise, but a pulse acting perpendicular to this direction may also arise, which can lead to a canting or tilting and compromise the efficacy of this valve. With the structure according to the invention as described, this can be avoided and a clean axial triggering force and a corresponding pulse can be achieved.

According to a proposed embodiment of the trigger valve according to the invention, with an outer surface on which the sleeve-like triggering part is seated, the bearing part can advantageously form a guide for the triggering part as it moves from the standby position into the triggering position. With this guide, it is again ensured that in the event of a triggering, a corresponding movement of the triggering part and thus of the perforation element from the standby position into the triggering position takes place, in which the perforation element can perforate a corresponding closure element and thus open a flow path.

The fact that the triggering part is described as sleeve-like in configuration does not mean that the latter has the form of a sleeve, especially one that is cylindrical throughout. It suffices in particular for the triggering part to have a sleeve section with which it is seated on the bearing part and can be moved along the bearing part. Along with such a sleeve section, the triggering part can in particular have a dome section that is closed on an end face, which forms a corresponding closure of the triggering part. On an inner surface of the dome section, in particular a bearing surface can be provided or formed, which serves as a thrust bearing for an end of the thermal triggering element, wherein this end can in particular be an axial end. A corresponding retention force of the thermal triggering element is thus transferred via this bearing surface to the dome section and consequently to the triggering part, which holds the triggering part in the standby position against the pretensioning applied by the spring means.

If the triggering part is configured with a dome section closing it on an end face as described in the preceding, then in the outer wall of the triggering part provision can be made of lateral exit openings that connect the interior of the triggering part to an outer side and that in particular are disposed directly below the dome section. Such exit openings can be used for distributing outflowing medium, which in the event that the trigger valve is triggered flows through the trigger valve to the exit openings and is released from there to the outside.

In a possible alternative embodiment, the bearing part is essentially in the form of a circular cylinder. A sleeve section of the trigger part (in particular one also provided with a circular diameter) can be seated on a bearing part thus configured and be especially well guided thereby during a transition from the standby position to the triggering position.

In order to be able to connect the trigger valve according to the invention easily to a container or vessel to be closed and to be opened in the triggering position, respectively, by said trigger valve, according to a possible embodiment of the invention the bearing part can have a connecting structure on one end, in particular a frontal end, for being joined and connected to an exit opening closed with a perforable closure element, wherein this connecting structure can in particular be a thread, e.g., a female thread.

According to an alternative embodiment, the trigger valve according to the invention can furthermore have a support bearing for the spring means, the spring means being arranged on the triggering part. In particular this support bearing can be arranged on the triggering part in a longitudinal extension on a first side of the triggering part, and the triggering part can have a thrust bearing for the thermal triggering element on a second side opposite the first side, wherein first the spring means and then, on the other side of the spring means, the thermal triggering element are arranged between the support bearing and the thrust bearing viewed in the longitudinal extension. In particular the spring means and the thermal triggering element can be arranged running along a center axis of the structure, thus achieving the symmetry described above as being advantageous to achieve and consequently the precise triggering of the passively thermally controlled triggering valve.

In an alternative embodiment, the support bearing described above can be formed in particular by a bearing pin, which is fastened on opposite wall areas of a sleeve-like section of the triggering part and extends perpendicular to the longitudinal extension of the triggering part, and which passes through guide slots in the bearing part. Besides simply forming the support bearing, such a structure confers other advantages. For instance, by guiding the bearing pin in the guide slots of the bearing part, an additional secure guiding is achieved, particularly in terms of preventing a possibility of the triggering part rotating, which would otherwise be the case. In addition, appropriate stops for the triggering position in particular can be achieved via the interaction of the guide slots in the bearing part with the bearing pin.

In another possible alternative embodiment of the trigger valve according to the invention, provision can be made of an axial bore in the bearing part, in which the spring means is arranged and abuts on one side on a spring bearing delimiting the axial bore on an end. A very precise arrangement of the spring means and thus a precise control of the pretension directed to the triggering part in the standby position can be achieved with such an axial bore, which in particular is centered in the bearing part (i.e., symmetrical about a center axis of the same).

The thermal triggering element can in particular also be a so-called thermo-bulb, in other words basically a glass vessel completely enclosing an interior space filled with a triggering fluid that, upon reaching a predetermined triggering temperature, expands until the glass vessel bursts.

The perforation element can take various shapes, e.g., that of a spike, a perforation blade, or the like. However, particular preference is given here to a perforation needle, in particular a hollow perforation needle, the lumen of which then forms a passage for guiding a fluid flowing into the trigger valve in the event that the latter is triggered.

In another embodiment, the trigger valve of the invention can have a triggering sensor system that emits a signal when the thermally controlled trigger valve is triggered. To this end, electrical contacts, for example, can be mounted on electrically conductive components of the trigger valve and connected to an electric switching circuit, wherein a closed circuit is formed by the electrically conductive components in the standby position, which is broken when the triggering position is assumed, thereby releasing the signal. For example, this can be brought about by an electrical contact being opened by the mechanical movement and separation of two elements of the trigger valve during the transition from the standby position to the triggering position. It is also possible for a thin wire, for example, to be torn or otherwise destroyed by the transition into the triggering position of the trigger valve and thus break the electric circuit. Also, a thermal triggering element, e.g., a glass vessel filled with a triggering fluid, can be made electrically conductive with a suitable coating and integrated in the circuit, but break this circuit in the event of triggering (e.g., if the glass vessel bursts). As an alternative, the triggering sensor system can also contain a circuit that is open in the standby position and that will close by the trigger valve being triggered and the triggering position being assumed, thus releasing the signal. This closing of a circuit can be effected by, for example, two electrically contacted components of the trigger valve being moved toward one another and brought into mechanical and electrical contact upon triggering and assumption of the triggering position.

If the triggering sensor system contains a circuit that is closed in the standby position and wired via the thermal triggering element (in particular a glass vessel such as a glass bulb filled with a triggering fluid), this circuit can also be used to heat the thermal triggering element deliberately to the triggering temperature by means of an electric current fed into said circuit, specifically by the thermal effect of the electric current flowing through the conductive section wired via the thermal triggering element, and thus instigate a remote triggering. To this end, the corresponding circuit can also be formed with the conductive section wired via the thermal triggering element without a triggering sensor system and be configured purely as a remote triggering mechanism.

Obviously all of the advantageous embodiments described in the preceding can also be implemented in combination with one another, as long as this is not explicitly ruled out or evidently precluded for a person skilled in the art. In particular, other advantages are achieved with the various combination possibilities, hence a combination of the features described as advantageous can turn out to be particularly advantageous in various demand situations.

BRIEF DESCRIPTION OF THE FIGURES

Other advantages and features, also advantages of the aforementioned combination possibilities in particular, will emerge from the following description of an exemplary embodiment, which refers to the appended figures. Therein.

DESCRIPTION OF THE EMBODIMENTS

The figures are schematic drawings and show a possible implementation of the invention by way of an example, but without limiting it to the specific representation and the structures and embodiments shown. In particular, the figures should be seen as mere schematic sketches and depictions for illustrating a possible implementation of the invention described herein rather than as true to scale or complete design drawings.

Figure 1:
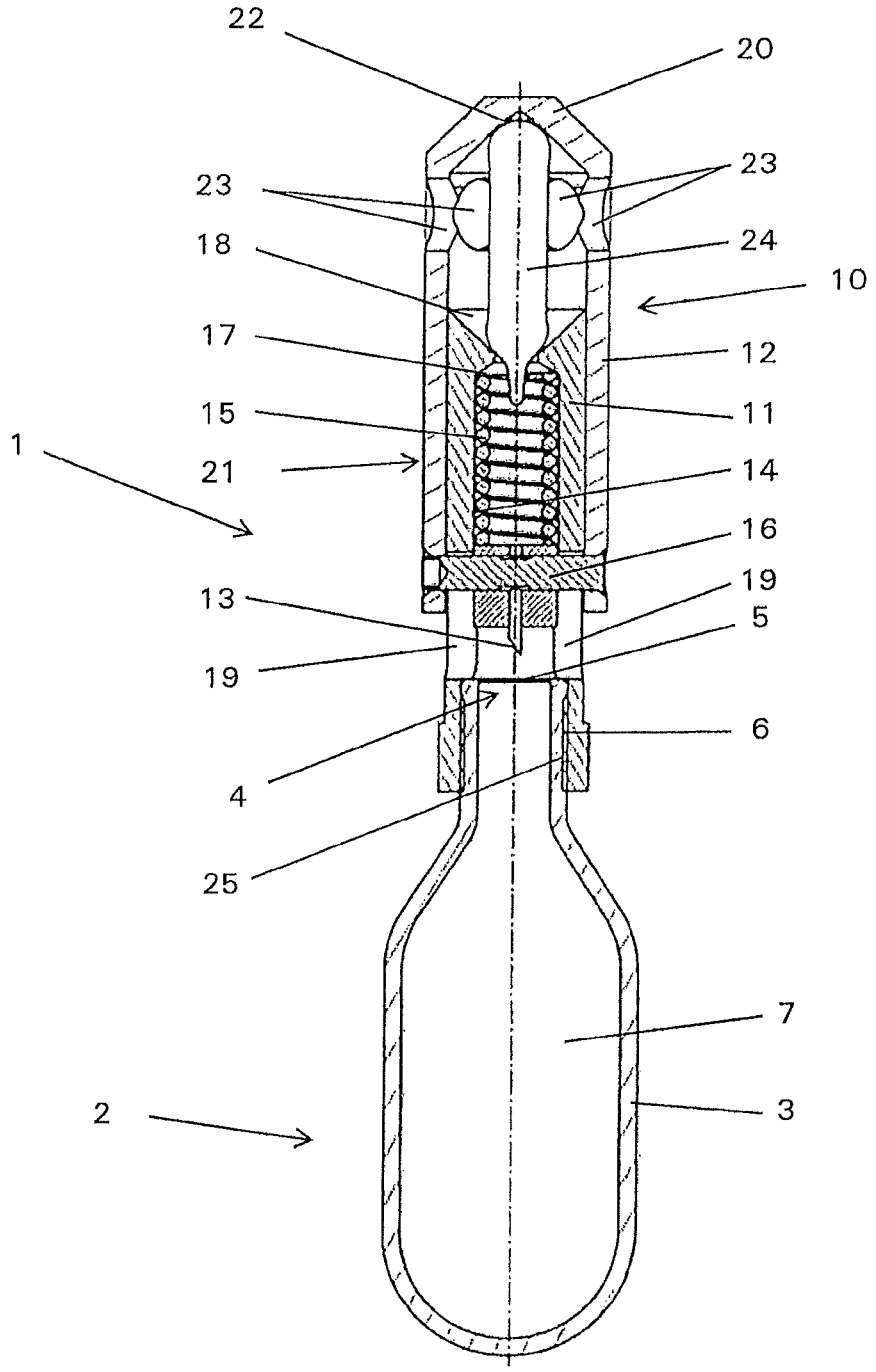
FIG. 1 shows, in a schematic sectional view, the structure of a fire extinguishing and/or fire protection device according to the invention.

A fire extinguishing and/or fire protection device according to the invention is first shown schematically in a sectional view in FIG. 1, and is designated with the reference 1. As essential components, this fire extinguishing and/or fire protection device 1 contains a pressure container 2 as well as a passively thermally controlled trigger valve 10. The pressure container 2 is shown configured in the manner of a pressure cartridge and contains an outer wall 3, which can be made, for example, out of a metal such as stainless steel and which encloses an inner volume 7. The pressure container 2 has an exit opening 4, which is hermetically sealed with a sealing film 5. The pressure container 2 has a male thread 6 in a neck-like zone near the exit opening 4. The inner volume 7 of the pressure container 2 is filled with a compressed extinguishing agent or extinguishing medium, which is not shown in any further detail here and is retained in the inner volume 7 and prevented from escaping via the exit opening 4 by the sealing film 5. The sealing film 5 is sufficiently strong and resilient such that it is able to resist a pressure prevailing in the inner volume 7 and exerted by the compressed extinguishing agent.

The trigger valve 10 is screwed onto the neck-like section with the exit opening 4 of the pressure container 2 and the male thread 6 provided thereon with a connecting piece provided with a female thread 25, and thus combined with the pressure container 2 into a unit, which as a whole forms the fire extinguishing and/or fire protection device 1. As can be readily discerned here, in particular the trigger valve 10 is seated directly on and connected to the pressure container 2, without interposition of a long pressure line or the like. Accordingly, the component shown here is compact; it can, for example, extend lengthwise for a total of ca. 100 mm (sum of the lengths of the pressure container 2 and the trigger valve 10) and have a total diameter at the widest point of ca. 20 to 25 mm. The capacity of the inner volume 7 of the pressure container can be 50 to 100 ml in this example.

The trigger valve 10, which constitutes separate subject matter of the invention in its own right and is in particular not limited to a use in the context of a fire extinguishing and/or fire protection device as shown here, but can also be used as a thermally controlled trigger valve in other applications, initially comprises two essential main components, namely a bearing part 11 on which the female thread 25 is formed and which is accordingly positionally fixed to the pressure container 2, and a triggering part 12. It can be discerned that the triggering part 12 is seated on the bearing part 11 like a sleeve, wherein a guide for a possible lengthwise movement of the triggering part 12 relative to the bearing part 11 is formed by the interaction of an outer shell surface of the (in this case cylindrical) bearing part 11 and a corresponding inner surface of the triggering part 12.

A perforation element 13, here in the form of a perforation needle, in particular a hollow perforation needle, is securely mounted on the triggering part 12 and extends longitudinally in the direction of the possible movement direction of the trigger part 12 relative to the bearing part 11. A bore 14 is drilled axially in the bearing part 11, in which bore a compression spring 14 is inserted. This compression spring 14 abuts on the one hand with a bearing pin 16, which traverses the bearing part 11 and is connected to the respective outer wall of the sleeve-like triggering part, and abuts on the other hand with a spring bearing 17, which spring bearing 17 is formed by a frontal narrowing or contact edge of the bore 14. The compression spring 15 therefore acts as a spring means between the bearing part 11 and the triggering part 12 and, in the standby position of the trigger valve 10 illustrated in FIG. 1, pretensions the triggering part 12 in the direction of a triggering position in a manner that will be explained in more detail.

On its outer end face opposite the spring bearing 17, the bearing part 11 has a funnel-shaped recess 18, which is connected to the bore 14 via an extension thereof (with a smaller diameter) in order to form a media channel.

Additionally, guide slots 19 are formed in the outer wall of the bearing part 11, which as oblong holes or elongated slots extending in the axial longitudinal direction are traversed by the bearing pin 16 and afford the latter a possibility of movement along the elongated slots 19 as well as provide a guide.

In addition to a sleeve-like section 21 with which it is seated on the bearing part 11, the triggering part 12 has a dome section 20, which closes the triggering part 21 on its frontal end opposite the connecting piece with the female thread 25. A thrust bearing 22 is formed on an inner surface of the dome section 22 for an elongated thermal triggering element 24 arranged along the longitudinal axis, which comes into abutment with one lengthwise end on the thrust bearing 22 and with a second lengthwise end in the funnel-shaped recess 18 of the bearing part 11. The thermal triggering element 24 thus holds the trigger valve 10 in its standby position by preventing the triggering part 12 from moving in the direction of the pressure container 2, a movement that would be triggered due to the spring force exerted by the compression spring 15 if the thermal triggering element 24 were lacking.

Figure 4:
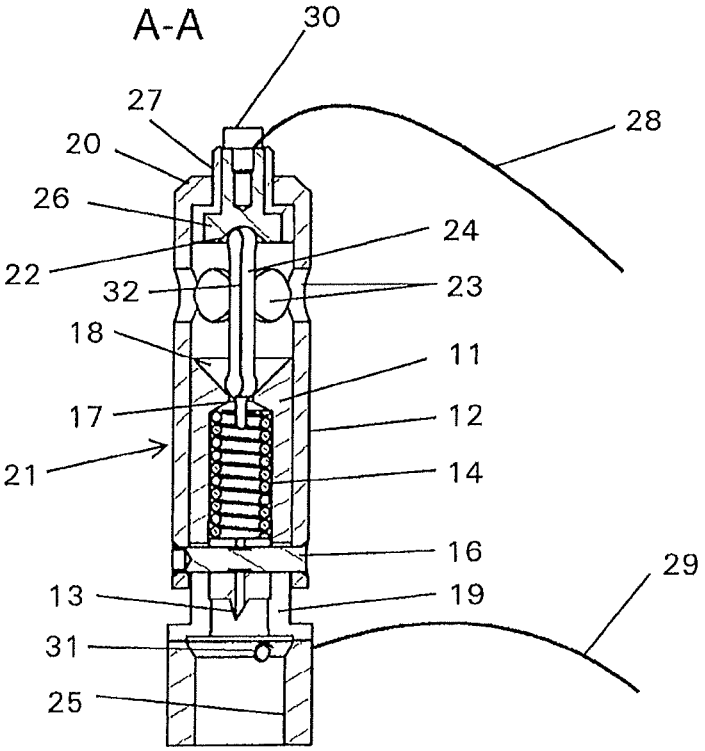
FIG. 4 shows the trigger valve of FIG. 3, in a sectional view along the line A-A in FIG. 3.

Immediately after the dome section 20, outflow openings 23 are provided along the perimeter, distributed in the lateral wall of the triggering part 12, out through which openings extinguishing medium flowing out of the inner volume 7, which first flows through the media channel formed by the bore 14, by the transition to the funnel-like recess 18, and by the interior of the dome section 20, can flow out in radial distribution in the event of a perforation of the sealing film 5 by the perforation element 13 triggered in the manner described further below. However, these outflow openings 23 can also be used to examine the triggering element 24 (in the form of a thermo-bulb here) in the standby position and thus inspect it for possible damage or abnormalities, such as a loss of the as a rule dyed triggering fluid. Since such an examination of the triggering element is not possible in the structure according to DE 199 11 530 C2 and FIG. 4 presented therein, this constitutes a further advantage of the embodiment according to the invention.

As has already been described, the trigger valve is shown in a standby position in FIG. 1.

In the event of a triggering, in which the thermal triggering element 24 (which can be a so-called thermo-bulb, in other words a glass vessel completely enclosing an interior space that is filled with a triggering fluid, in particular a small glass tube sealed at both ends) is actuated, in other words bursts due to an expansion of the triggering fluid, the trigger valve 10 is actuated by the triggering part 12 being moved relative to the bearing part 11 in a downward direction onto the pressure container 2 in FIG. 1.

Figure 2:
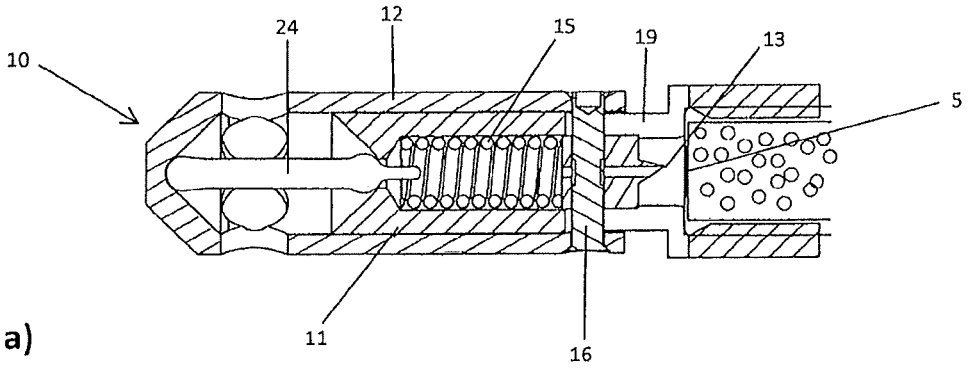
FIG. 2 shows the mode of action of the passively thermally controlled trigger valve also according to the invention that can be used to form the fire extinguishing and/or fire protection device according to the invention, with reference to four "snapshots" (individual drawings a-d) during a triggering process.
Figure 2:
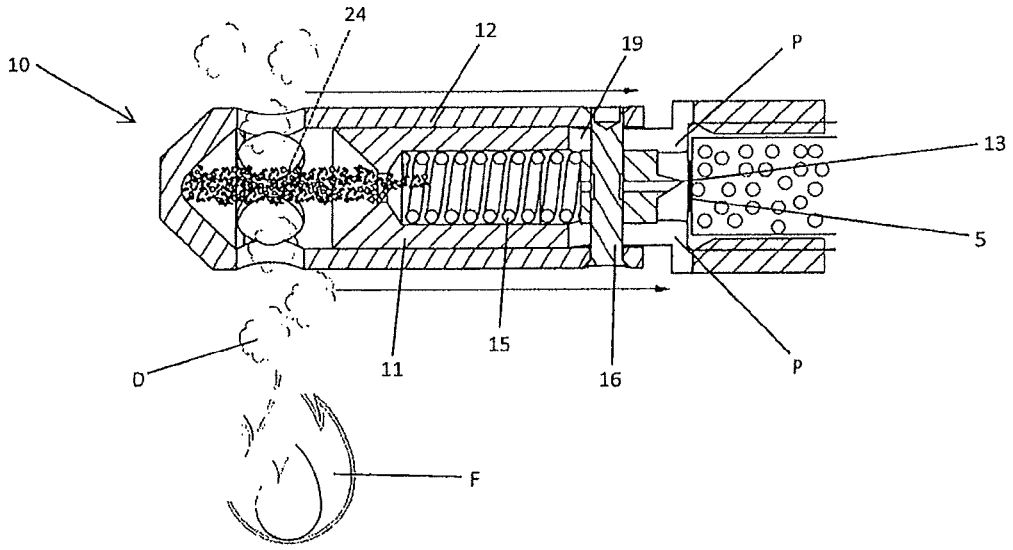
Figure 2:
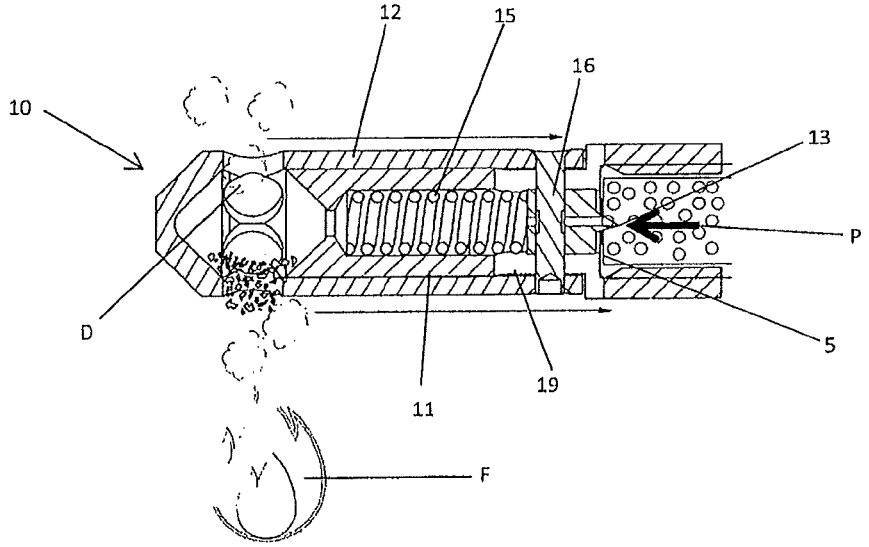
Figure 2:
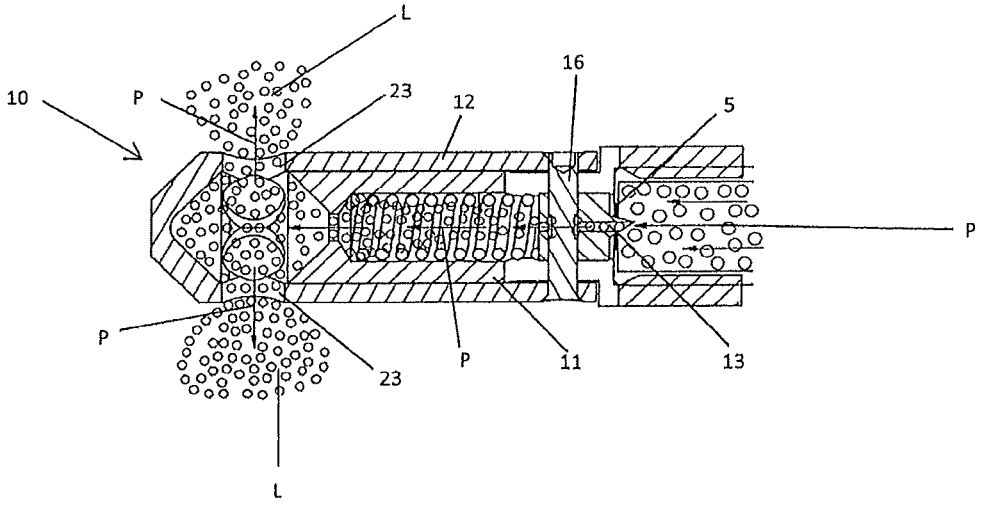

This is again depicted in the illustrations a-d in FIG. 2. FIG. 2*a* again shows the thermal trigger valve in the standby position, in which the thermal triggering element 24 is intact and, in its position clamped between the bearing part 11 and the triggering part 12, braces the triggering part 12 in the standby position, namely against the force being exerted by the compression spring 15 and acting in the direction of a triggering position.

If the thermal triggering element 24 is triggered as a result of a temperature increase above a triggering temperature caused, for example, by a fire symbolized by the flame F in FIG. 2*b*, wherein the triggering fluid contained therein expands and thus bursts the glass vessel, then the "holder" holding the triggering part 12 in the standby position relative to the bearing part 11 is eliminated such that the triggering part 12 driven by the compression spring 15 and by the force that the latter releases is moved in the direction indicated by the arrow P in FIG. 2*b* and moves or is displaced relative to the bearing part 11, specifically on the outside thereof and guided by the outer surface thereof. The fact that the triggering fluid in the thermal triggering element 24 (which is a thermo-bulb in this case) vaporizes in this triggering event is indicated with D.

FIG. 2*c* now shows how the trigger valve 10 reached the triggering position in which the perforation element 13 punches through, i.e., perforates, a closure element, e.g., the sealing film 5. Here it is readily discernible that the bearing pin 16, guided in the guide slots 19 of the bearing part 11, is moved in the direction of the triggering position, wherein the compression spring 15 has at least partially relaxed, transferred its compression force to the bearing pin 16 and thus pushed the triggering part 12 forward in the direction of the triggering position. A medium that was previously retained by the closure element (e.g., the sealing film 5), in particular the extinguishing medium contained in the pressure container 2, can now flow out from a container in the direction of the arrow P of FIG. 2*c* and enter the triggering valve 10. Finally and as shown in FIG. 2*d*, there it continues to flow along the media channel in the direction of the arrows P and exits from the outflow openings 23 in the form of clouds of extinguishing agent designated with L.

With regard to the structure of the trigger valve 10, here it is especially important to emphasize that, by means of the special configuration of the bearing element 11 and of the triggering element 12 that is arranged seated thereon like a sleeve and is moveable relative thereto and bears the perforation element 13, and the arrangement of the compression spring 15 and the thermal triggering element 24 symmetrically about the center axis of the trigger valve 10 and after one another, a very symmetrical structural form is achievable, with the advantage of a force exerted by the compression spring 15 that is directed very accurately in the direction of the desired displacement in the event of triggering, without undesired and interfering lateral pulses being induced here by an asymmetric arrangement of one of the elements. A very precise and good guiding of the triggering part 12 relative to the bearing part 11 is also achieved, on the one hand through the cooperation of the bearing part 11 (with its outer surface structured like a bearing journal) with the sleeve-like section 21 of the triggering part 12, and on the other hand through the additional guiding that the bearing pin 16 undergoes in the guide slots 19.

Figure 3:
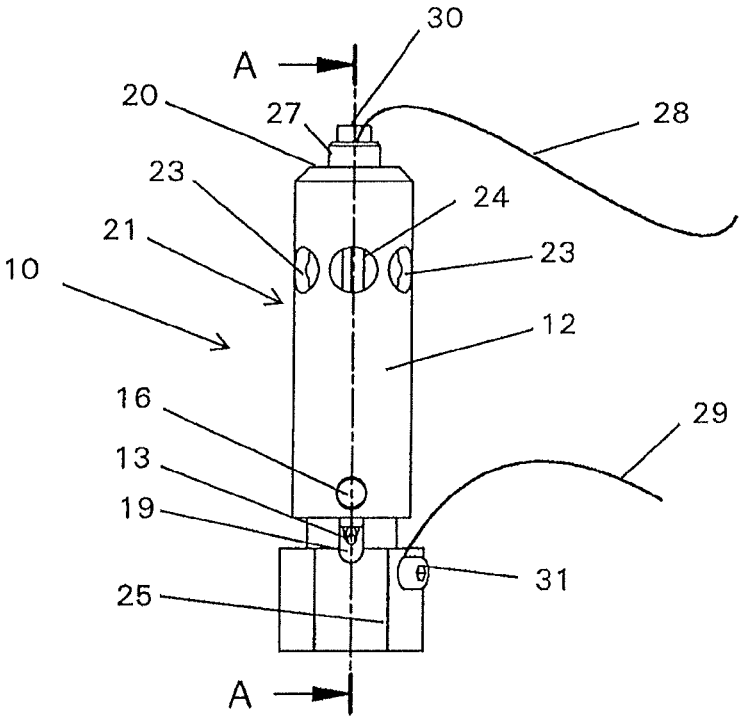
FIG. 3 shows a trigger valve according to the invention, with the integration of a triggering sensor system depicted.

A modification of a trigger valve 10 (shown by itself and without the pressure container here) is illustrated in FIGS. 3 and 4, in a side view (FIG. 3) and in a sectional view (FIG. 4) taken along the line of intersection A-A according to FIG. 3. In terms of the essential elements and functional parts, this trigger valve is constructed exactly the same as the one shown in FIGS. 1 and 2. Hence each of the elements that are functionally the same are designated with identical reference signs. Unless deviations are indicated in the following, they interact in the manner described above with reference to FIGS. 1 and 2. Accordingly, reference shall be made to the above description of the exemplary embodiment of FIGS. 1 and 2 in terms of the structure and basic function of the triggering element 10 of FIGS. 3 and 4.

A difference in the structure between the exemplary embodiments of FIGS. 1 and 2 on the one hand and FIGS. 3 and 4 on the other hand lies in the design of the thrust bearing 22 with which the thermal triggering element comes in abutment. Whereas this thrust bearing 22 is simply formed on an inner surface of the dome section 20 in the example shown in FIGS. 1 and 2, a thrust bearing part 26 is provided in the embodiment according to FIGS. 3 and 4. This thrust bearing part 26 is inserted in an opening in the dome section 20, with interposition of an electrical insulation element 27 that electrically insulates the thrust bearing part 26 made of an electrically conductive material from the triggering part 12 also made of an electrically conductive material, and has the actual thrust bearing 22 in the form of a recess on a surface in the interior of the triggering part 12 facing the thermal triggering element 24. The thrust bearing part 26 and electrically insulating element 27 combination is fastened and fixed, e.g., press fit, in the opening of the dome section 20 in which this combination is inserted.

An end of the thrust bearing part 26 illustrated above in the figures is run through the dome section 20 to the outside in such a way that it is exposed. An electric wire 28 is fastened to this end of the thrust bearing part 26 with a terminal screw 30 and electrically contacts the thrust bearing part 26 there.

Another electric wire 29 is fastened and electrically connected with a terminal screw 31 to the bearing part 11, in the area where the female thread 25 is also formed. The bearing part 11 is also made of an electrically conductive material such as brass or stainless steel, for example.

Another special feature here is that the thermal triggering element 24 is provided with an electrical lead, in this case with an electrically conductive coating 32, which extends over the entire length of the thermal triggering element 24. In particular this electrically conductive coating 32 extends continuously up into the zones in which the thermal triggering element 24 is disposed in the funnel-like recess 18 in the bearing part 11 and is mechanically connected there to the material of the bearing part 11, and also up into the zones in which the thermal triggering element 24 comes in abutment with the thrust bearing 22 of the thrust bearing part 26 and is mechanically connected there to the material of the thrust bearing part 26. A continuous electrical connection from the electric wire 28 via the thrust bearing part 26, the electrically conductive coating 32, and bearing part 11 to the electric wire 29 is thus established. The two electric wires 28 and 29 can thus be connected to, e.g., an electric sensor circuit and a closed, monitored electric circuit can be created thereby.

If the thermal triggering element 24 is triggered, in other words bursts, in the manner described with reference to FIGS. 2*a*)-*c*) for the first embodiment of the thermal trigger valve 10 that works the same way, the section of the electrical connection formed by the electrically conductive coating 32 and thus the circuit as a whole will be interrupted. A voltage drop detected at this site by, for example, the sensor circuit can then be interpreted as a signal for triggering the thermal trigger valve 10 and thus a compact fire extinguishing and/or fire protection device 1 equipped with this valve. This signal can also be used, for example, for giving off an alarm, for indicating that the fire extinguishing and/or fire protection device 1 needs to be replaced, for initiating other actions (e.g., triggering other extinguishing devices), or the like. The sensor system chosen here, which in a normal situation has a closed circuit, is thus preferred over one that only closes a circuit in a triggering event, as it will give off an alarm rather than threatening to fail during a power failure, for instance.

However, the continuous electrical connection from the electric wire 28 via the thrust bearing part 26, the electrically conductive coating 32, and the bearing part 11 to the electric wire 29 and a circuit thus formed can also be used, as an alternative or in addition to forming a trigger sensor system, for forming a mechanism for remotely triggering the valve. If a strong current is fed into this line, either for a specific period or even as just a temporary pulse, the conductive coating 32 heats up due to the electrical resistance and thus leads to an influx of heat into the triggering fluid, which then causes the thermal triggering element 24 to burst and thus trigger the valve.

Although obvious to a person skilled in the art, it nevertheless should be emphasized here that the embodiment of the thermal trigger valve shown in FIGS. 3 and 4 for forming the fire extinguishing and/or fire protection device 1 of the invention in the manner shown in FIG. 1 can and will be combined with a compressed gas container as shown therein, and that the triggering process will then take place as shown in FIGS. 2*a*)-*c*), the only difference being that in addition a signal will be emitted by the trigger sensor system.

From the preceding description of the exemplary embodiments, it has again become clear what special properties and advantages arise from both the compactly configured fire extinguishing and/or fire protection device 1 according to the invention and the passively thermally controlled trigger valve 10 constructed according to the invention.

LIST OF REFERENCES

1 Fire extinguishing and/or fire protection device
2 Pressure container
3 Wall
4 Exit opening
5 Sealing film
6 Male thread
7 Inner volume
10 Trigger valve
11 Bearing part
12 Triggering part
13 Perforation element
14 Bore
15 Compression spring
16 Bearing pin
17 Spring bearing
18 Funnel-like recess
19 Guide slot
20 Dome section
21 Sleeve-like section
22 Thrust bearing
23 Outflow opening
24 Thermal triggering element
25 Female thread
26 Thrust bearing part
27 Electrical insulation element
28 Electric wire
29 Electric wire
30 Terminal screw
31 Terminal screw
32 Electrically conductive coating
D Vapor (Dampf)
F Flame
L Extinguishing medium (Löschmedium)
P Arrow (Pfeil)

The invention claimed is:

1. A passively thermally controlled trigger valve of a fire extinguishing or fire protection device, wherein the trigger valve comprises a bearing part;

a triggering part that is movable relative to the bearing part between a standby position and a triggering position;

a perforation element arranged on the triggering part;

a spring arranged between the bearing part and the triggering part which pretensions the triggering part relative to the bearing part in the triggering position;

a support bearing for the spring arranged on the triggering part; and a thermal triggering element which holds the triggering part in the standby position against the pretensioning exerted by the spring; wherein the triggering part at least in one section forms a sleeve section that surrounds and is seated on the bearing part and is moveable in a longitudinal direction of the bearing part on the bearing part between the standby position and the triggering position; wherein the support bearing is formed by a bearing pin attached to opposite wall zones of a section of the triggering part and extending perpendicular to the longitudinal extension of the triggering part wherein the bearing pin passes through guide slots in the bearing part.

2. A fire extinguishing or fire protection device, formed from a pressure container filled with a pressurized extinguishing medium and having an exit opening that is sealed with a closure element perforable by means of a perforation element; wherein pressurized extinguishing medium is retained in the pressure container; and the passively thermally controlled trigger valve in accordance with claim 1, seated directly on the exit opening;

wherein the perforation element is pretensioned in the direction of the triggering position and held by the thermal triggering element in the standby position that is different from the triggering position and wherein when triggered by a predetermined triggering temperature being reached, the thermal triggering element releases the perforation element; wherein the perforation element driven by the pretensioning to which it is subjected in the standby position moves into the triggering position and perforates the closure element.

3. The fire extinguishing or fire protection device according to claim 2, wherein the pressure container has an inner volume of 10 ml to 1500 ml.

4. The fire extinguishing or fire protection device according to claim 2 wherein the extinguishing medium is an oxygen-binding or oxygen-displacing extinguishing gas.

5. The fire extinguishing or fire protection according to claim 2 wherein the passively thermally controlled trigger valve has a media guide channel connected to the exit opening and distribution openings for the extinguishing medium and through which the extinguishing medium is distributed in the event of triggering.

6. The fire extinguishing or fire protection device according to claim 2 wherein the thermal triggering element is a glass vessel completely surrounding an inner space with a triggering fluid enclosed in the inner space, said triggering fluid expanding at the predetermined triggering temperature until the glass vessel bursts.

7. The fire extinguishing or fire protection device according to claim 2 wherein the pressure container has a first screw thread in a zone of the exit opening and that the passively thermally controlled trigger valve has a second screw thread complementary to the first screw thread in a connecting section, wherein the pressure container and the passively thermally controlled trigger valve are connected by screwing the first and second screw threads together in order to form the fire extinguishing or fire protection device.

8. The fire extinguishing or fire protection device according to claim 2 further comprising a triggering sensor system that emits a signal if the passive thermally controlled trigger valve has been triggered.

9. The fire extinguishing or fire protection device according to claim 2 further comprising an electrically actuatable remote triggering device.

10. A passively thermally controlled trigger valve according to claim 1 adapted to be seated directly on an exit opening of a pressure container.

11. The passively thermally controlled trigger valve according to claim 1, wherein the bearing part forms a guide for the triggering part as the triggering part moves from the standby position into the triggering position; wherein the guide has an outer surface on which the triggering part is seated.

12. The passively thermally controlled trigger valve according to claim 1, wherein the triggering part further includes a dome section that is closed on an end face.

13. The passively thermally controlled trigger valve according to claim 12, wherein a bearing surface is formed as a thrust bearing for an axial end of the thermal triggering element on an inner surface of the dome section.

14. The passively thermally controlled trigger valve according to claim 12, further comprising lateral exit openings in an outer wall of the triggering part which connects the interior of the triggering part with an outer side and wherein the exit openings are arranged directly below the dome section.

15. The passively thermally controlled trigger valve according to claim 1 wherein the bearing part has an essentially circular cylindrical form.

16. The passively thermally controlled trigger valve according to claim 1, wherein the bearing part has a connecting structure that connects the bearing part to an exit opening and wherein the connecting structure is sealed with the perforable closure element.

17. The passively thermally controlled trigger valve according to claim 1, wherein the triggering part has the support bearing in a longitudinal extension on a first side and a thrust bearing for the thermal triggering element on a second side opposite the first side, wherein between the support bearing and the thrust bearing, first the spring and, on the other side of the spring then the thermal triggering element are arranged behind one another when viewed in the longitudinal extension.

18. The passively thermally controlled trigger valve according to claim 1, further comprising an axial bore in the bearing part in which bore the spring is arranged and comes into abutment on one side with a spring bearing delimiting the axial boring on an end face thereof.

19. The passively thermally controlled trigger valve according to claim 1, further comprising, as the thermal triggering element, a glass vessel completely surrounding an inner space, with a triggering fluid enclosed in the inner space and expanding at a predetermined triggering temperature until the glass vessel bursts.

20. The passively thermally controlled trigger valve according to claim 1 further comprising a perforation needle as the perforation element.

21. The passively thermally controlled trigger valve according to claim 1, further comprising a triggering sensor system that emits a signal if the passively thermally controlled trigger valve is triggered.

22. The passively thermally controlled trigger valve according to claim 1, further comprising an electrically actuatable remote triggering device.

* * * * *